US006167660B1

(12) United States Patent
Sama

(10) Patent No.: US 6,167,660 B1
(45) Date of Patent: Jan. 2, 2001

(54) COUNTER FLASHING

(75) Inventor: Joseph A. Sama, Wadsworth, OH (US)

(73) Assignee: Tremco Incorporated, Beachwood, OH (US)

( * ) Notice: Under 35 U.S.C. 154(b), the term of this patent shall be extended for 0 days.

(21) Appl. No.: 09/411,499

(22) Filed: Oct. 4, 1999

(51) Int. Cl.[7] ..... E04D 1/36
(52) U.S. Cl. ..... 52/58; 52/60; 52/61; 52/62
(58) Field of Search ..... 52/58, 60, 62, 52/97, 310, 61

(56) References Cited

U.S. PATENT DOCUMENTS 1,428,457 * 9/1922 Swenson ..... 52/62
2,995,870 * 8/1961 O'Hanlon ..... 52/62
3,981,108 * 9/1976 Berg .
4,156,993 * 6/1979 Sorrells, Jr. .
4,165,589 * 8/1979 De Carteret ..... 52/62
4,189,886 * 2/1980 Frohlich ..... 52/310
4,190,989 * 3/1980 Sakharoff .
5,123,208 * 6/1992 Kirby ..... 52/58
5,381,632 * 1/1995 Damron .

* cited by examiner

*Primary Examiner*—Carl D. Friedman
*Assistant Examiner*—Kevin McDermott
(74) *Attorney, Agent, or Firm*—Calfee, Halter & Griswold LLP

(57) ABSTRACT

A counter flashing system is provided for protecting a termination end of a roofing material and providing an asthetic cover. An anchor has a first end attached to a wall and a second end defining a mounting slot for receiving a counter flashing. A mounting end of the counter flashing is inserted into the slot and fastened. The slot and the mounting end of the counter flashing both include a plurality of teeth which engage each other to prohibit movement of the counter flashing. A free end of the counter flashing extends out from the mounting end and covers a portion of the wall which includes a roofing seal. The anchor and counter flashing protect the roofing seal from exposure to weather and sunlight as well as providing as aesthetically pleasing appearance. With the present invention, the components can be easily assembled, disassembled, or replaced.

20 Claims, 4 Drawing Sheets

COUNTER FLASHING

BACKGROUND OF THE INVENTION

The present invention is directed to the roofing arts. It finds particular application to a counter flashing system and method that seals roofing material. It is to be appreciated that the present invention also finds application to other roof and wall sealing systems which may include reglets, flashings, and/or coping structures.

Reglet, flashing, and counter flashing devices have been used to form water-tight seals and covers for joints or termination areas of different wall materials of roofs. Many of these prior art devices have been found to be difficult to assemble and install, and have been unsatisfactory in installations covering the termination of a water-proof roofing membrane extending along a portion of the wall. Once installed, many prior art reglet, flashing and counter flashing assemblies are very difficult to replace often requiring the components to be ripped out and re-installed. In addition, longitudinally adjacent sections of these devices have been difficult to properly align, thus, presenting the possibility of leaks at adjoining section joints. This makes a precise installation difficult and expensive to achieve. Additionally, installation forces exerted on the components of some prior art reglet or flashing structures cause the components to rotate or be pulled. As a result, sealants may pull away from the wall and/or break between adjoining sections causing adverse effects to the water-proofing performance of the wall membranes.

The present invention provides a new and unique counter flashing system and method which cures the above problems and others.

SUMMARY OF THE INVENTION

In accordance with the present invention, a roof counter flashing for attachment to a wall is provided. An anchor has a first end which attaches to a wall and a second end which has a slot. The slot includes a plurality of teeth. A counter flashing has a mounting end and a free end where the mounting end is removably mounted within the slot of the anchor and has a plurality of teeth that engage the plurality of teeth in the slot. A fastener maintains the mounting end of the counter flashing in engagement with the slot of the anchor to secure the counter flashing to the anchor.

In accordance with a more limited aspect of the present invention, the first end of the anchor is mounted within the wall.

In accordance with a more limited aspect of the present invention, the anchor includes a ledge which receives and holds stucco material.

In accordance with yet a more limited aspect of the present invention, the anchor further includes an edge extending out from the anchor between the first end and the second end which defines a channel for receiving a sealant.

In accordance with a more limited aspect of the present invention, a splice plate snap connects to the edge of the anchor and attaches to the free end of the counter flashing and covers a portion of the counter flashing and anchor.

In accordance with another aspect of the present invention, a counter flashing system is provided. An anchor means includes a securing means for securing the anchor means to a wall. The anchor means includes a mounting means for mounting a counter flashing and includes a grip means. A counter flashing which covers a portion of a wall is removably mounted to the mounting means by engaging the grip means. The grip means reduces the movement of the counter flashing.

In accordance with a more limited aspect of the present invention, the grip means includes at least one projection which engages the counter flashing.

In accordance with a more limited aspect of the present invention, the counter flashing includes at least one projection which abuts with at least one projection of the grip means.

In accordance with a more limited aspect of the present invention, the mounting means includes a slot which receives a portion of the counter flashing for mounting.

One advantage of the present invention is that the counter flashing is detachable from the anchor without having to damage any of the components.

Another advantage of the present invention is that the anchor grips the counter flashing with a plurality of teeth which prohibit the counter flashing from moving or disconnecting from the anchor.

Another advantage of the present invention is that the components quickly and easily connect and disconnect to one another simplifying installation and removal of the system.

Another advantage of the present invention is that the termination bar is enclosed by the counter flashing protecting it from weather and ultraviolet rays which extends the life and functionality of the termination bar and its roof seal.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
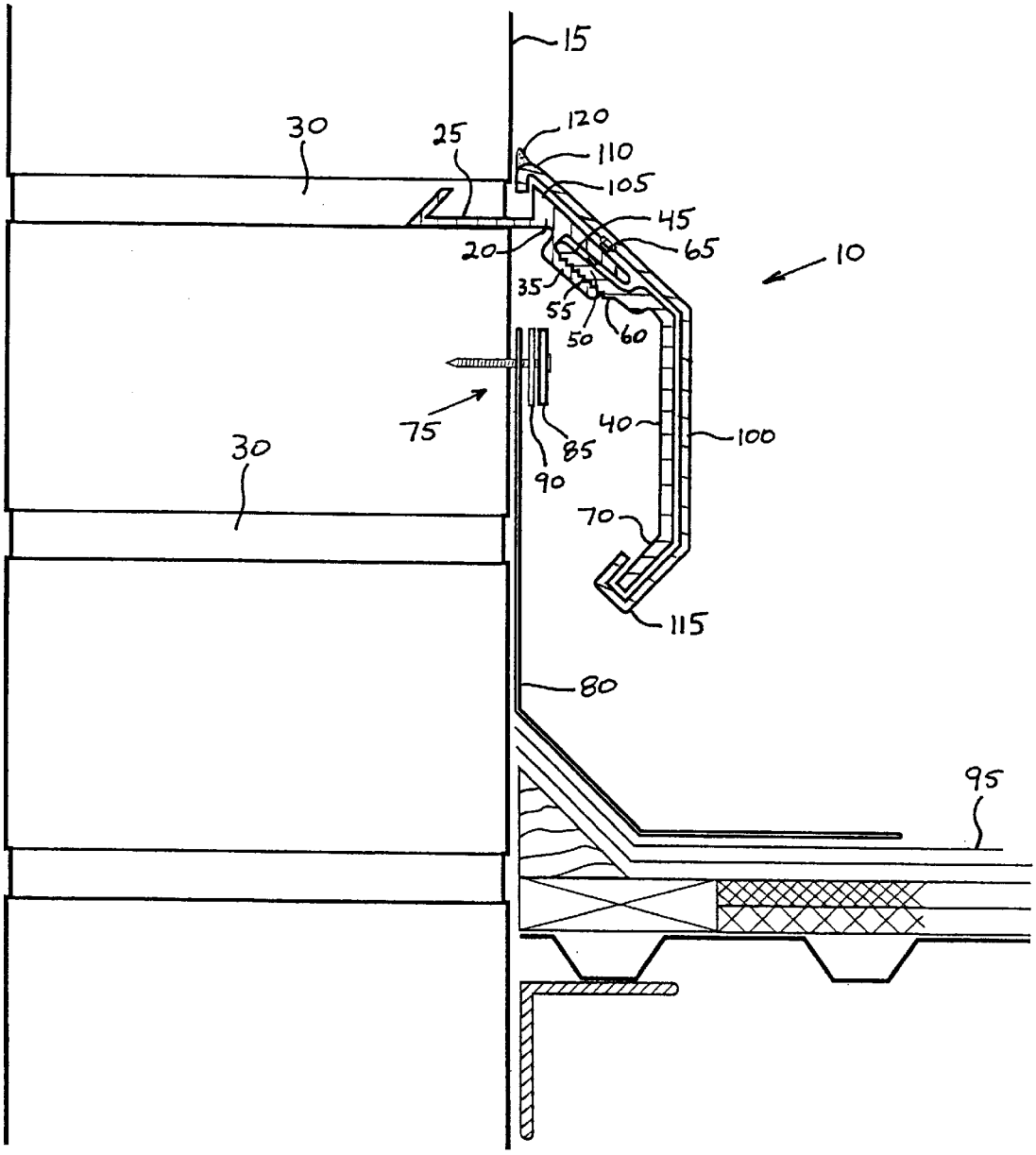
FIG. 1 is a cross-sectional view of the present invention mounted to a vertical wall.

With reference to FIG. 1, a counter flashing system 10 of the present invention is shown mounted to a wall 15. The system includes an anchor 20 which has at one end a wall extension 25. The extension 25 is inserted and mounted to a mortar joint 30 of the wall 15. For example, the extension is inserted into a saw-cut joint or an open mortar joint. The extension 25 secures the anchor 20 to the wall 15. At its other end and extending out from the wall, the anchor 20 includes a mounting portion 35 that provides for the mounting of a counter flashing 40 to the anchor 20. In the preferred embodiment, a slot 45 is defined in the mounting portion 35 which receives a mounting end 50 of the counter flashing 40. Along one side of the slot 45, one or more projections 55 are formed which face inward. The mounting end 50 of the counter flashing includes one or more projections 60 which engage along side the projections 55 of the slot 45. In this manner, the mounting portion 35 grips the mounting end 50 of the counter flashing to reduce the movement of the counter flashing, secure it to the anchor and prohibit unintentional removal. In the preferred embodiment, the projections include one or more teeth which interlock with each other. It will be appreciated that the gripping function between the mounting end 50 of the counter flashing and the anchor 20 can include any variety or combination of projections and/or grooves which will reduce the movement of the two parts. A fastener 65 is threaded through the mounting portion 35 into the slot 45 and applies surface pressure to the mounting end 50 of the counter flashing. The surface pressure maintains the engagement of the mounting end 50 against the slot projections 55.

Figure 2:
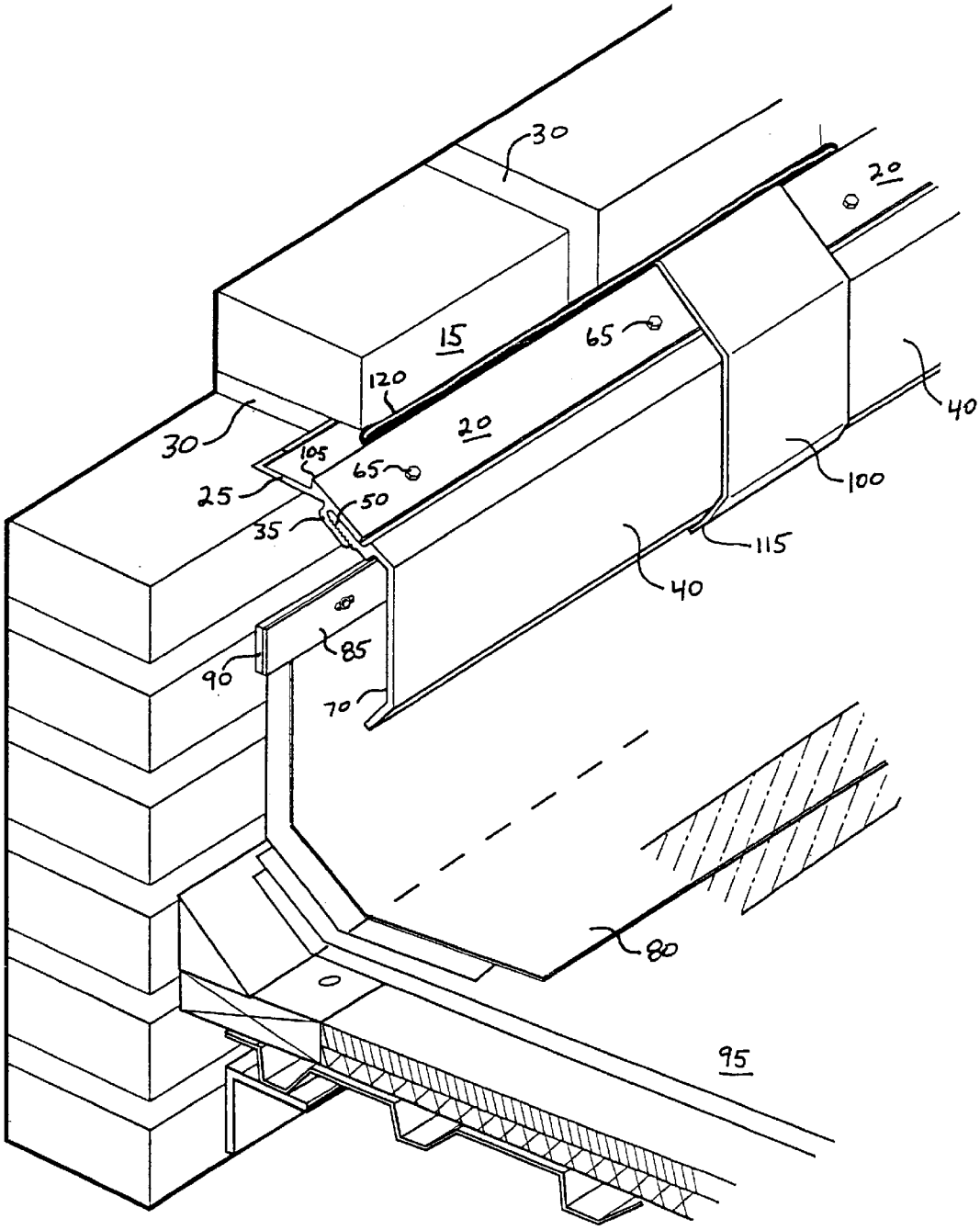
FIG. 2 is an isometric view of FIG. 1 illustrating a splice plate connection.

With further reference to FIGS. 1 and 2, the counter flashing 40 includes a free end 70 which extends out from the mounting end 50 and covers a portion of the wall 15. In particular, the counter flashing system 10 covers and protects a roofing seal 75 from exposure to light and moisture. The free end 70 is formed having any desired geometry and length necessary to cover the roof seal 75. The roofing seal includes a roof flashing 80 which is sealed against the wall 15 with a termination bar 85 and elastomeric tape 90 positioned therebetween. The roof flashing 80 holds down a roofing material 95.

Depending on the length of the counter flashing system 10 and the wall 15, it is installed end-to-end as shown in FIG. 2. To seal the end-to-end joint between counter flashing systems 10, a splice plate 100 is attached over the joint. As best seen in FIG. 1, an edge 105 is formed on the anchor 20 which provides for a top end 110 of the splice plate 100 to be snapped-on and connected to the anchor 20. A bottom end 115 of the splice plate is formed in a hook-like shape which hooks and locks around the free end 70 of the counter flashing. The splice plate 100 is preferably formed to substantially match the geometry of the counter flashing 40 but can be any desired shape. A sealing material 120, for example caulk, is applied between the wall 15 and the edge 105 of the anchor in a channel formed therebetween to prevent moisture from entering.

Preferably, the bottom end 115 is configured for easy connection and disconnection to the free end 70 of the counter flashing 40. Of course, depending upon the sizes and shapes chosen for the splice plate 100 and counter flashing 40, the connecting portion of the splice plate may be positioned at any suitable location along the counter flashing and shaped to attach thereto.

With the present configuration, the counter flashing 40 can be easily removed and replaced simply by removing the fastener 65 and detaching the counter flashing from the anchor 20 without having to remove and install a new anchor. A new counter flashing is easily installed by inserting it into the slot 45 and tightening the faster 65. Furthermore, the counter flashing 40 and anchor 20 grip one another with the teeth 55 and 60 which prevents the two components from sliding apart.

Figure 3:
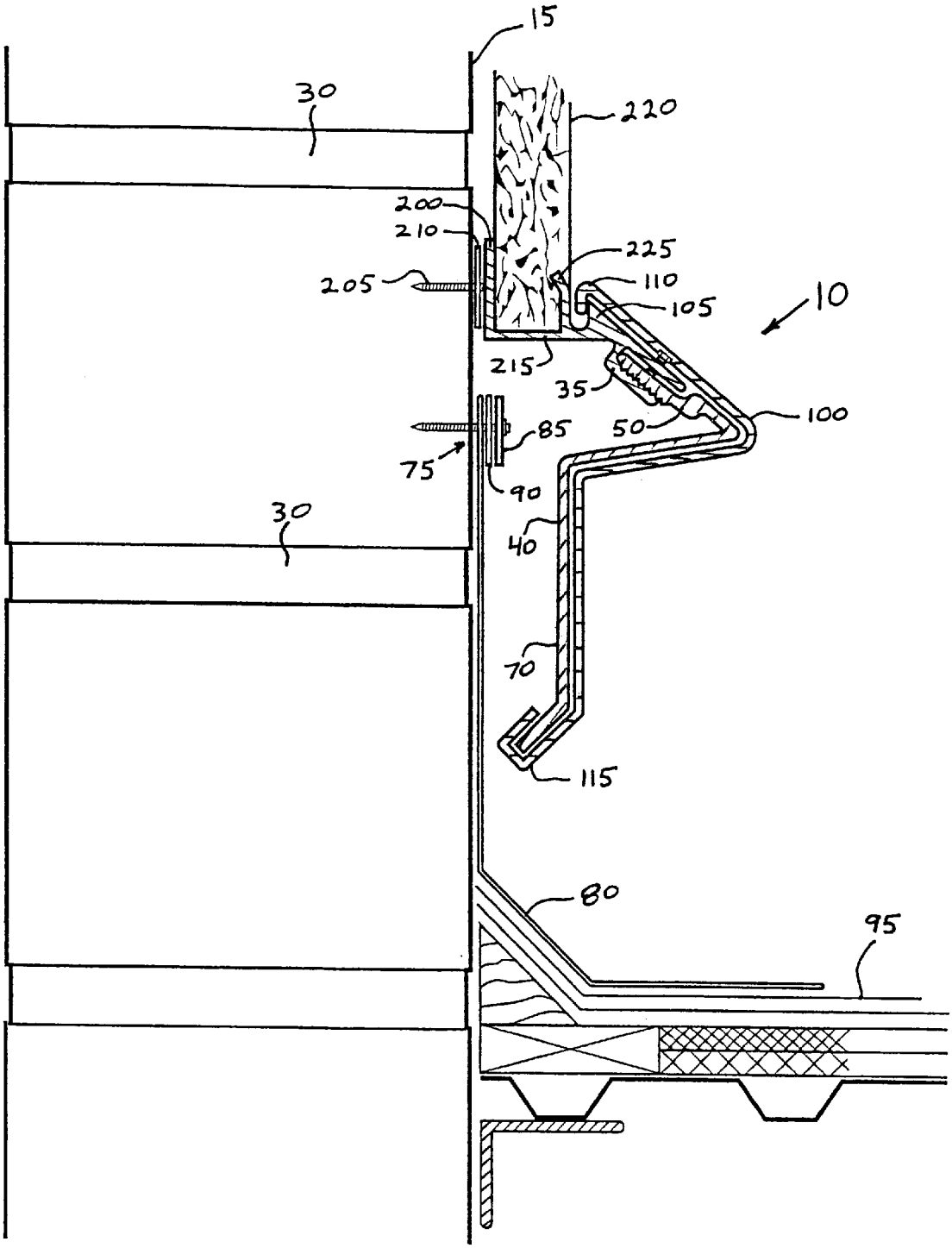
FIG. 3 is a cross-sectional view of another embodiment of the present invention mounted to a vertical wall.
Figure 4:
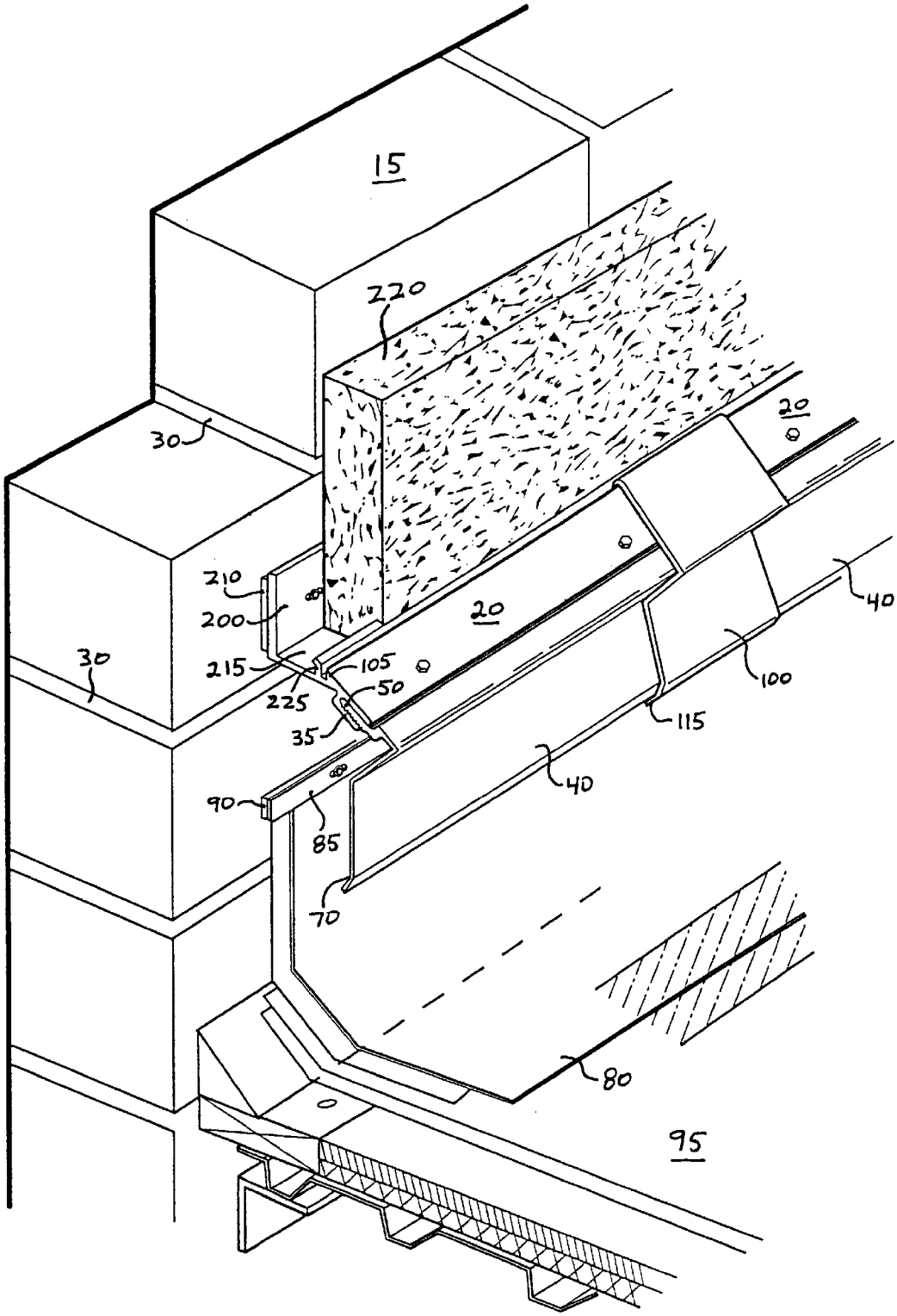
FIG. 4 is an isometric view of FIG. 3 illustrating a splice plate connection.

With reference to FIGS. 3 and 4, an alternative embodiment of the present invention is shown which is mounted to an outside surface of the wall 15. The anchor 20 includes a mounting surface 200 which is parallel to the wall 15 and is secured thereto with one or more fasteners 205. Elastomeric tape 210 may be placed therebetween to provide additional sealing properties. The anchor 20 further includes an extension 215 which defines a ledge for receiving and maintaining stucco material 220. Preferably, the extension 215 is perforated to allow moisture from the stucco 220 to pass through. To further secure the stucco 220, a stucco mount 225 projects out from the extension 215 and engages the stucco 220 to hold it in place. In this manner, the stucco 220 is maintained against the mounting surface 200.

Preferably, the counter flashing 40, the anchor 20 and splice plate 100 are made from extruded aluminum, steel or other metal. It should be appreciated that spacings between components have been exaggerated in the figures only for clarity and might not actually be installed with such spaces.

The components of the present invention are configured to allow for quick and easy installation. Of course, one of ordinary skill in the art will appreciate that there are many ways to form the components of the present invention so that they cooperatively attach to each other, for example, by hooking, snapping or the like.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

I claim:

1. A roof counter flashing system for attachment to a wall comprising:

an anchor having a first end for attachment to a wall and a second end having a slot, the slot including a plurality of teeth;

a counter flashing having a mounting end and a free end, the mounting end being removeably mounted within the slot of the anchor and having a plurality of teeth that engage the plurality of teeth in the slot; and a fastener which maintains the mounting end of the counter flashing in engagement with the slot of the anchor to secure the counter flashing to the anchor.

2. The roof counter flashing system as set forth in claim 1 wherein the first end of the anchor being mounted within the wall.

3. The roof counter flashing system as set forth in claim 1 wherein the first end of the anchor includes a first surface parallel to the wall which is secured to the wall.

4. The roof counter flashing system as set forth in claim 3 wherein the anchor further includes a second surface extending out from the first surface, the second surface defining a ledge to receive stucco.

5. The roof counter flashing system as set forth in claim 4 wherein the ledge includes a stucco mount extending out from the ledge to engage the stucco.

6. The roof counter flashing system as set forth in claim 1 wherein the fastener is threaded through the anchor into the slot and applies pressure to the mounting end of the counter flashing.

7. The roof counter flashing system as set forth in claim 1 wherein the anchor further includes a caulk edge extending out from the anchor between the first end and the second end, the caulk edge defining a channel for receiving a sealant.

8. A roof counter flashing system for attachment to a wall comprising:

an anchor having a first end for attachment to a wall and a second end having a slot, the slot including a plurality of teeth;

a counter flashing having a mounting end and a free end, the mounting end being removeably mounted within the slot of the anchor and having a plurality of teeth that engage the plurality of teeth in the slot;

a fastener which maintains the mounting end of the counter flashing in engagement with the slot of the anchor to secure the counter flashing to the anchor; and a splice plate shaped to cover at least a portion of the second end of the anchor and a portion of the counter flashing, the splice plate including a first end which attaches to the free end of the counter flashing and a second end which snap connects to the anchor.

9. A counter flashing system comprising:

an anchor means including a securing means for securing the anchor means to a wall, the anchor means further including a mounting means for mounting a counter flashing;

a grip means formed on the mounting means for gripping a counter flashing; and a counter flashing for covering a portion of the wall, the counter flashing having a plurality of teeth for engaging the grip means, and being removeably mounted to the mounting means, the grip means reducing movement of the counter flashing.

10. The counter flashing system as set forth in claim 9 wherein the grip means includes at least one projection which engages the counter flashing.

11. The counter flashing system as set forth in claim 10 wherein at least one tooth of the plurality of teeth of the counter flashing abuts with the at least one projection of the grip means.

12. The counter flashing system as set forth in claim 9 wherein the grip means includes a plurality of teeth which interlock with the plurality of teeth from the counterflashing.

13. The counter flashing system as set forth in claim 9 wherein the mounting means includes a slot which receives a portion of the counter flashing for mounting, the grip means being formed within the slot.

14. The counter flashing system as set forth in claim 13 further including a fastener extending from the mounting means and applying pressure to the counter flashing, the fastener maintaining the counter flashing against the grip means.

15. The counter flashing system as set forth in claim 9 wherein the anchor means further includes a surface for mounting stucco.

16. The counter flashing system as set forth in claim 15 wherein the surface for mounting stucco is perforated to allow moisture to pass through.

17. A counter flashing system comprising:

an anchor means including a securing means for securing the anchor means to a wall, the anchor means further including a mounting means for mounting a counter flashing;

a grip means formed on the mounting means for gripping a counter flashing;

counter flashing for covering a portion of the wall and being removeably mounted to the mounting means by engaging the grip means, the grip means reducing movement of the counter flashing; and a splice plate for covering a portion of the anchor means and a portion of the counter flashing, the splice plate including a first end connected to the anchor means and a second end connected to the counter flashing.

18. The counter flashing system as set forth in claim 17 wherein the first end is snap-connected to the anchor means and the second end is hooked to the counter flashing.

19. The counter flashing system as set forth in claim 9 wherein the securing means includes an extension for mounting within a wall.

20. The counter flashing system as set forth in claim 9 wherein the securing means includes a surface for attachment to an outer surface of a wall.

* * * * *